United States Patent [19]

Morris

[11] 4,129,244

[45] Dec. 12, 1978

[54] STRIP SHEARING AND JOINING METHOD AND APPARATUS

[75] Inventor: Terrence P. Morris, Bedford Heights, Ohio

[73] Assignee: Guild International, Inc., Ohio

[21] Appl. No.: 785,237

[22] Filed: Apr. 6, 1977

Related U.S. Application Data

[63] Continuation of Ser. No. 630,263, Nov. 10, 1975, abandoned.

[51] Int. Cl.[2] ..... B23K 9/02

[52] U.S. Cl. ..... 228/170; 228/5.7; 228/13; 228/32; 228/212

[58] Field of Search ..... 228/5.7, 44.1 R, 170, 228/13, 32, 212, 213; 219/161; 156/159, 507

[56] References Cited

U.S. PATENT DOCUMENTS

| | | | |
|---|---|---|---|
| 2,196,941 | 4/1940 | Reed et al. | 228/213 X |
| 3,198,931 | 8/1965 | Klempay | 228/5.7 |
| 3,259,964 | 7/1966 | Engel | 228/49 B X |
| 3,377,013 | 4/1968 | Hahne | 228/44.1 R |
| 3,458,103 | 7/1969 | Davis | 228/5.7 |

*Primary Examiner*—Al Lawrence Smith
*Assistant Examiner*—K. J. Ramsey
*Attorney, Agent, or Firm*—Maky, Renner, Otto & Boisselle

[57] ABSTRACT

A crop shearing and joining method and apparatus includes a manually operable crop shearing assembly for producing clean linear edges at the ends of respective strips, sheets or the like, and a joining assembly for welding or otherwise securing the ends of two different strips or sheets together. Also, a strip aligning and clamping assembly comprising two independently operable clamping devices utilizes one of the clamping devices to provide an alignment stop for aligning the end of one strip relative to the welding torch or the like in the joining assembly and then uses that aligned strip end to facilitate alignment of the strip end to be joined therewith. Moreover, the clamping devices provide substantially full backing support of the aligned strip ends during the joining operation.

6 Claims, 7 Drawing Figures

STRIP SHEARING AND JOINING METHOD AND APPARATUS

This is a continuation of application Ser. No. 630,263, filed Nov. 10, 1975, now abandoned.

BACKGROUND OF THE INVENTION

The present invention relates generally, as indicated, to a strip shearing and joining method and apparatus.

When welding or otherwise joining the leading end of one metal, plastic, coated metal or other strip or sheet with the trailing end of another preferably similar strip or sheet, it is desirable that the respective end edges be relatively fixedly positioned in proximity or in abutment with each other and in alignment with the joining tool, such as an electric arc welder, or the like. It is also desirable, especially when the ends of two strips are to be welded, that the ends are freshly sheared for cleanliness and for accurate parallel alignment of the same at the welding station.

One example of a mechanism for accurately spacing and positioning the ends of metal strips to be joined may be found in U.S. Pat. No. 3,239,909. In another device disclosed in U.S. Pat. No. 3,403,833 a combination slitter and welder is positioned over a fluid operated clamping arrangement, which includes two independent actuated clamps, at least one being laterally movable with its clamped strip end to a preferred position with respect to the other clamped strip end for welding of the two ends. The prior art strip shearing, clamping and joining devices employ relatively expensive, heavy and bulky hydraulic or pneumatic operating and control equipment, usually including hydraulic cylinders, lines, reservoirs, pumps and the like, which add to the cost, complexity and size of the equipment. The prior art hydraulically operated mechanisms also generally use a lower clamp bar that is relatively fixed on a frame bed over which the sheet or strip material may pass and an upper movable clamp bar located above the fixed lower clamp bar and movable toward the latter to clamp a strip therebetween, and to obtain such movement of the upper clamp bar suitable support and mounting structure therefor is required, which further adds to the expense, weight and bulkiness of the equipment.

SUMMARY OF THE INVENTION

In the present invention a simplified, relatively inexpensive, compact, portable strip shearing and welding or otherwise joining apparatus is provided, which is a principal object of the invention. A common frame bed is preferably provided for a strip aligning and clamping assembly, a strip joining assembly and a crop shear assembly, the latter being provided for trimming the trailing end of one strip or sheet and the leading end of another strip or sheet that are to be joined. The strip joining assembly is located above the frame bed over which the strip material passes, and the strip aligning and clamping assembly includes first and second clamping devices mounted on the frame bed to clamp, respectively, the trailing end of one strip and the leading end of another with the respective strip ends aligned for welding or otherwise joining thereof by the joining device.

Each of the clamping devices has an upper clamp bar fixed relative to the frame and a lower clamp bar vertically movable toward the fixed clamp bar to clamp a strip therebetween and away from the fixed clamp bar to open a clearance space therebetween for relatively unimpeded passage of the strip. Moreover, at least one of the movable clamp bars has a stop surface positionable in the clearance space to block the same and to provide for abutment with the end of the opposite strip to align the latter with respect to the joining device.

By locating the respective fixed clamp bars above the strip material, the distance between the latter when clamped and the strip joining device will be a constant regardless of the thickness of the strip, and the strip ends will be supported by the movable clamp bars during joining. Additionally, the upper, strong, heavy framing previously required for prior art strip clamps utilizing movable upper clamp bars is eliminated. Also, both clamping devices as well as the crop shear assembly are preferably manually actuated, which eliminates the requirement for hydraulic equipment, controls and connections on the frame bed, further reducing the complexity, weight and bulkiness of the apparatus.

With the foregoing in mind, it is a primary object of the invention to provide a joining method and apparatus for strip material, sheet material or the like improved in the noted respects.

Another object of the invention is to reduce the cost, weight, bulkiness and the like of such a joining apparatus.

An additional object of the invention is to effect relatively facile alignment of two strip ends or the like to be joined.

A further object of the invention is to provide a secure backing or back support for the ends of two strips, sheets or the like to be joined by welding or other joining process.

Still another object of the invention is to provide portability in a strip shearing, clamping and joining apparatus.

Still an additional object of the invention is to provide such a relatively simplified shearing, clamping and joining apparatus with an automated joining device.

These and other objects and advantages of the present invention will become more apparent as the following description proceeds.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DESCRIPTION OF THE PREFERRED EMBODIMENT

Figure 1:
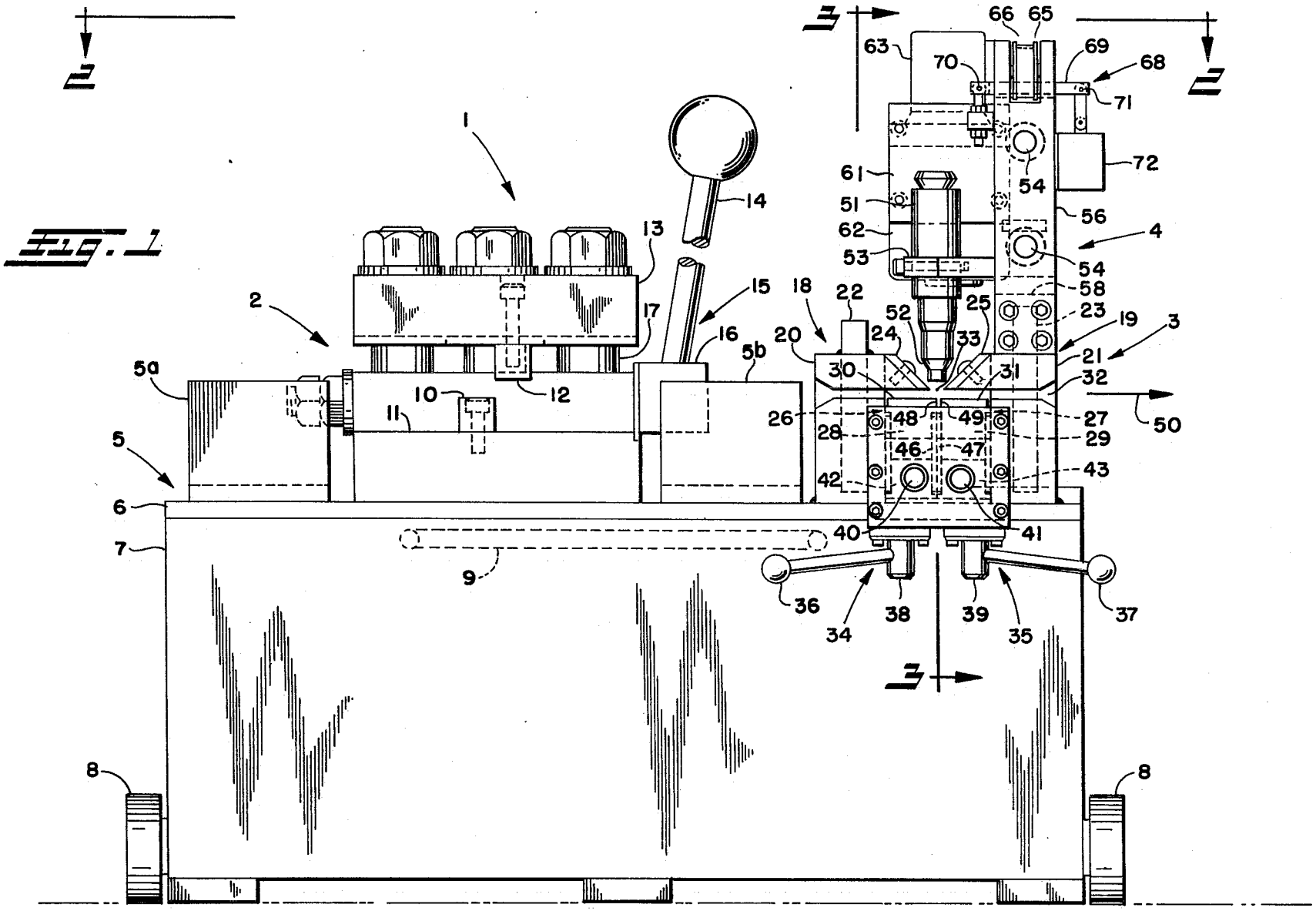
FIG. 1 is a side elevation view of a preferred form of strip shearing and welding apparatus in accordance with the present invention.
Figure 2:
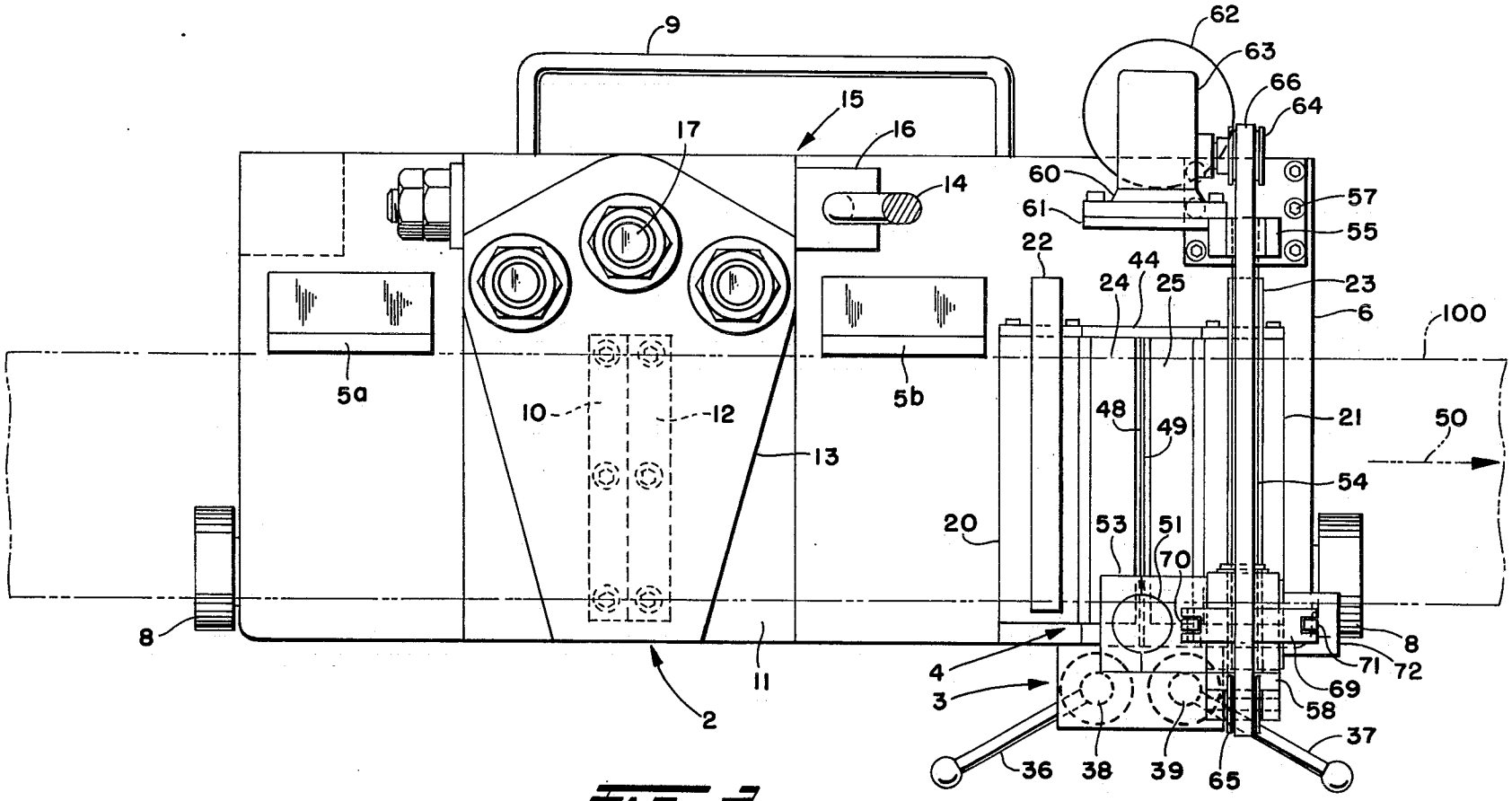
FIG. 2 is a top plan view of the apparatus looking in the direction of the arrows 2—2 of FIG. 1.
Figure 3:
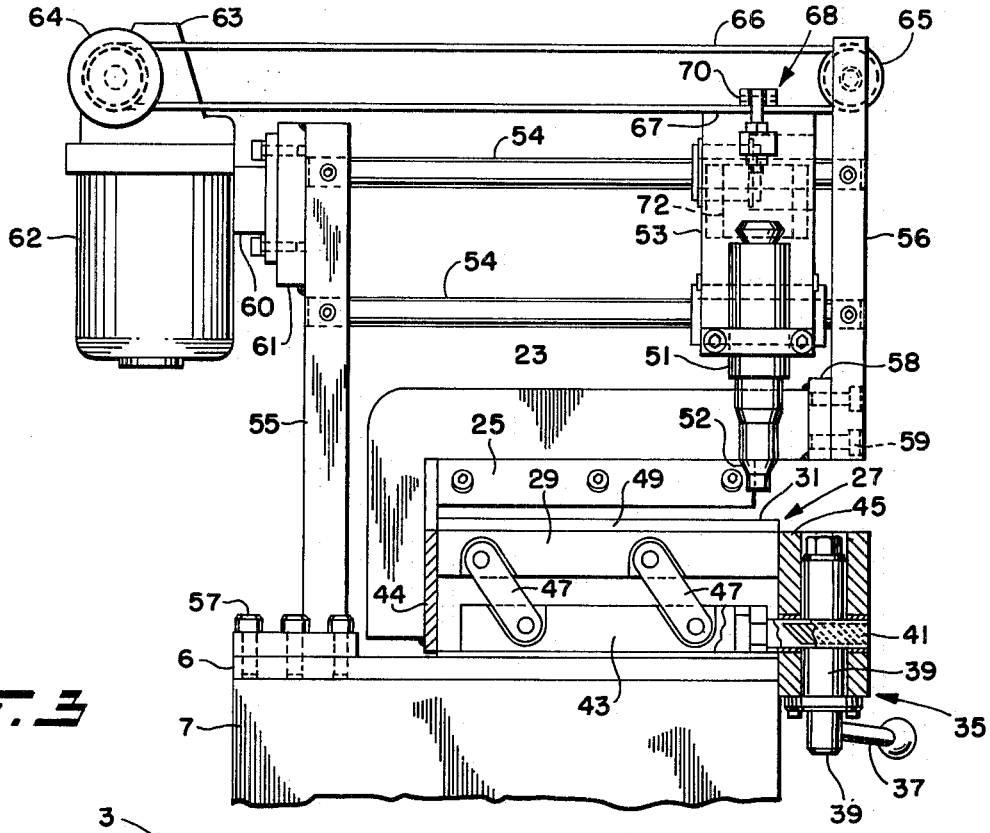
FIG. 3 is a partial sectional elevation view of the strip aligning and clamping assembly and strip joining assembly of the apparatus looking generally in the direction of the arrows 3—3 of FIG. 1.

Referring now more particularly to the drawings, wherein like reference numerals are used to designate like elements in the several figures, and initially to FIGS. 1, 2 and 3, the strip shearing and welding apparatus of the present invention is generally designated at 1, and includes a crop shear assembly 2, a strip aligning and clamping assembly 3, and a strip joining assembly 4, all of which are mounted on a frame bed 5. The frame bed 5 includes strip guides 5*a*, and 5*b*, a steel table plate or the like 6 and a base 7, the latter having attached thereto rollers 8 and a handle 9 which facilitate moving the apparatus 1 to operative and storage locations, thus making the same relatively portable. Because of the relatively compact nature of the apparatus 1 making it adaptable to be moved about on rollers, the apparatus may be rolled to an operative station, for example, in a continuous strip processing line between strip rolling or forming equipment and strip coiling equipment, to weld or otherwise join the respective trailing and leading ends of two strips together. Of course, if desired, the strip shearing and welding apparatus 1 need not be portable and may be fixedly positioned in the strip line or in another useful location. Moreover, although the invention will be described below particularly with reference to joining two ends of metal strip material by welding, it will be appreciated that the apparatus of the invention may be employed to join two ends of sheet material other than strips and of material other than metal by electric arc welding respective edges of the leading and trailing strip ends or by other joining techniques, such as, for example, flame welding, ultrasonic welding, soldering, brazing, and the like.

In the crop shear assembly 2 a fixed crop shearing blade 10 is secured to the base plate 11 and is positioned to cooperate with a movable crop shearing blade 12, which is secured to a vertically movable carriage support 13, to crop shear the ends of strip or sheet material or the like located therebetween providing clean, linear strip ends in preparation for joining of the ends at the strip joining assembly 4, in a manner to be subsequently described. Crop shearing of a strip may be effected as by manually moving the shearing handle 14 that operates a crop shear actuator mechanism 15, for example, by rotating a pinion 16 coupled to a rack, not shown, to slide the movable carriage support 13 on its mounting studs 17 toward the base plate 11 so that the fixed and movable crop shearing blades 10, 12 will cooperate to shear the strip therebetween.

It will be appreciated that other conventional linkages and actuators may be used to effect manual or automatic, if desired, operation of the crop shear assembly 2 as alternatives to the described crop shear actuator mechanism 15. Moreover, while the described manually operated crop shear assembly 2 is preferred, particularly for its relatively uncomplicated construction, other shearing devices may be employed within the scope of the invention such as, for example, a slitter blade arrangement.

At the strip aligning and clamping assembly 3, most clearly illustrated in FIGS. 1 and 3, the crop sheared, clean, linear ends of the respective trailing and leading ends of two strips, sheets or the like may be aligned with each other and with respect to the strip joining assembly 4 and firmly clamped in position for joining by the strip joining assembly. The strip aligning and clamping assembly 3 may include two similar adjacent clamping devices 18, 19, the former being intended to clamp the leading end of one strip and the latter being intended to clamp the trailing end of another strip. The clamping devices 18, 19 include respective fixed upper clamp bars 20, 21 which are preferably formed of steel or similar material for good electrical conductivity and strength, mounted on respective frame support members 22, 23 attached to the table plate 6. Each fixed clamp bar may have a copper pad 24, 25 secured to respective mitered edges in a V-shape formation as shown for good electrical conductivity to facilitate the electric arc welding operation of the strip joining assembly 4. Aligned beneath the upper fixed clamp bars 20, 21 are respective independently movable lower clamp bars 26, 27, which include respective constrained vertically movable plates 28, 29, for example, formed of steel or the like for eletrical conductivity and strength with a copper pad 30, 31 secured to the top thereof for enhanced electrical conductivity further to facilitate electric arc welding of the respective strip ends. The vertically movable clamp bars 26, 27 may be independently moved toward their respective fixed clamp bars 20, 21 to clamp a strip therebetween and away from their respective fixed clamp bars to provide a clearance space 32 therebetween for relatively unimpeded passage of a strip through the strip aligning and clamping assembly 3. Also, a slight gap 33 is preferably provided between the copper pads for flowing away of molten metal or other material released during the welding or other joining process.

The clamping devices 18, 19 have respective independently operable actuators 34, 35, which respectively include handles 36, 37 that rotate pinions 38, 39 to move racks 40, 41 coupled to further sliding plates 42, 43 for moving them laterally within the space provided between the clamping guides 44, 45 that in part form a housing for the clamping devices and mount the same to the frame bed 5. Respective toggle linkages 46, 47 connect the further lateral sliding plates 42, 43 to the constrained vertical sliding plates 28, 29, and the mechanical cooperation between the toggle linkages and the respective sliding plates and between the constrained sliding plates and their clamping guides convert the lateral linear movement of the further sliding plates to a perpendicularly oriented linear motion of the vertically movable clamps bars 26, 27 to clamp and to unclamp a strip between the latter and the respective fixed clamp bars 20, 21.

At least one of the moveable clamp bars 26, 27 includes a stop portion 48 or 49, respectively, for facilitating alignment with respect to the strip joining assembly 4 the end of the opposite strip, that is, the strip to be clamped by the opposite clamping device. Such stop portions 48, 49 may be formed by the linear edge walls of the respective copper pads 30, 31 laterally bounding the gap 33 and/or by the edge walls of the constrained sliding plates 28, 29. To utilize this stop alignment feature of the strip aligning and clamping assembly 3, referring to FIG. 1, for example, the crop sheared trailing end of one strip, not shown, is brought through the clearance space 32 in the strip aligning and clamping assembly 3 in the direction of the arrow 50 sufficiently far that the clean, linear trailing strip end clears the clamping device 18. Then, after operating the clamp actuator 34 to move the movable clamp bar 26 into the clearance space 32 substantially to close the same, the clean, linear end of the opposite strip may be moved back in a direction opposite that indicated by the arrow 50 to abut the edge wall stop portion 48 placing that strip edge in proper alignment with the strip joining assembly 4. The clamping device 19 may then be actuated firmly to clamp that trailing strip end in place, and after withdrawal of the movable clamp bar 26 the aligned end of the still clamped strip then will provide an alignment stop for the leading end of the next strip to be joined thereto.

In the strip joining assembly 4 an electric arc welding torch 51 or other strip joining tool is mounted to position its electrode end 52 approximately at the apex of the V defined by the two copper pads 24, 25 and just above the linear edge juncture of two aligned strip ends, not shown. The welding torch 51 is desirably mounted on a torch carriage 53, which is slidably supported on a pair of linear guides 54 to move the welding torch 51 and its electrode end 52 over the linear extent of the two aligned strip ends to join the two. The linear guides 54 are mounted between a pair of joining device frame supports 55, 56, the former being fastened to the table plate 6 by bolts 57 or other fastening means and the latter being fastened to a support plate 58 welded or otherwise fastened to the frame support member 23 by bolts 59 or other fastening means.

A bracket support 60 fastened to a plate 61 welded or otherwise secured to the joining device frame support 55 provides a mounting for an electric motor 62, a transmission coupling 63 and a pulley 64, and between the pulley 64 and another pulley 65, which is supported by the joining device frame support 56, is a torch drive belt 66. Preferably, the electric motor 62 continuously drives the belt 66 via the transmission coupling 63. Adjacent the top portion 67 of the torch carriage 53 is located a clutch mechanism 68 for coupling the moving torch drive belt 66 to the torch carriage 53 to slide the latter along the linear guides 54, and thereby to move the welding torch 51 over the aligned and clamped strip ends during the joining operation. The clutch mechanism 68 may include a belt clamping arm 69 that has its opposite ends respectively pivotally mounted at a fixed pivot support 70 attached to the torch carriage 53 and at a movable pivot support 71 attached to a mechanical switch device 72 also attached to the torch carriage. By operating the mechanical switch device 72 to shift the movable pivot support 71 in an upward direction away from the drive belt 66, the clutch mechanism 68 becomes disengaged allowing the torch carriage 53 to be moved manually on its linear guides 54 or to remain in a stationary storage location, for example, proximate the joining device frame support 55 to store the welding torch 51 relatively remotely from the strip aligning and clamping assembly 3. From such a stored location the torch carriage 53 may be automatically moved at a relatively accurately controlled speed along the aligned clamped strip ends to weld the same when the mechanical switch device 72 is operated to shift the belt clamping arm 69 in a downward direction so that the belt clamping arm clamps the drive belt 66 against the torch carriage top 67, whereby the belt pulls the torch carriage 53 along its linear guide 54.

If desired, the clutch mechanism 68 may include a release linkage, not shown, to disengage the clutch mechanism when the torch carriage 53 nears or reaches the joining device frame support 56 at the conclusion of the strip joining operation. Alternatively, upon moving the torch carriage 53 to abutment with the joining device frame support 56, the still moving drive belt 66 may slip through the clutch clamping arrangement between the clamping arm 69 and the torch carriage top 67. Moreover, it will be appreciated that other clutch mechanisms or the like may be employed for selectively connecting the torch carriage 53 to the drive belt 66, for example, to effect automated movement of the torch carriage 53 on its linear guides in both directions. Furthermore, while it is preferred that the torch carriage 53 be moved automatically at least during the welding operation from the standpoint of safety and for uniformity of the welded joint or seam, if desired, alternatively the torch carriage 53 may be manually moved on its guides both during the welding operation and thereafter to shift the welding torch back to its stored location.

Turning now to FIGS. 4 through 7, exemplary operation of the strip shearing and welding apparatus 1 will be described with reference to crop shearing and joining the leading end of one strip 101 from a new coil, for example, to the trailing end of another strip 100 which has substantially completely been used up.

Figure 4:
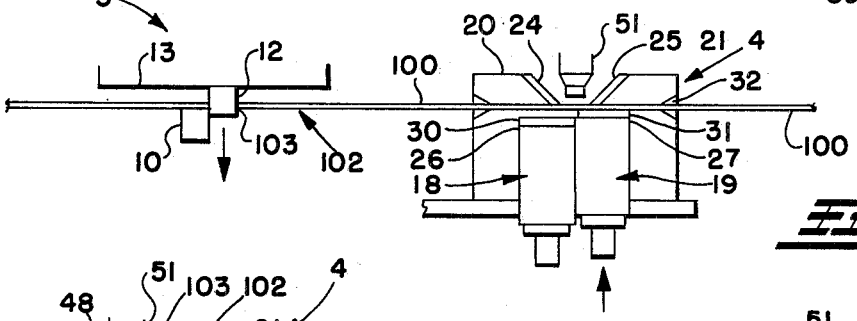
FIGS. 4, 5, 6 and 7 are schematic representations of the apparatus illustrating various stages of operation thereof.

Initially, as depicted in FIG. 4, the first strip 100 is positioned in the apparatus 1 such that part of the trailing end 102 is located between the blades 10, 12 of the crop shear assembly 2. Part of the strip 100 also may be located in the strip aligning and clamping assembly 3, and preferably either of the clamping devices 18, 19 is operated, for example, the clamping device 19, as shown, to clamp the strip 100 firmly in order to provide rigidity therein when the crop shear assembly 2 is operated, thus enhancing the linearity of the crop sheared end 103. Then, upon pulling on the shearing handle 14 the moveable crop shearing blade 12 is drawn from its stored position illustrated in FIG. 1 toward the fixed crop shearing blade 10 to crop shear the trailing end 102 producing a clean, linear end 103 suitable for welding by the welding torch 51. Afterwards, the clamping device 19 may be released and the first strip 100 pulled on through the strip aligning and clamping assembly 3 at least to a point such that the sheared end 103 clears the clamping device 18.

Figure 5:
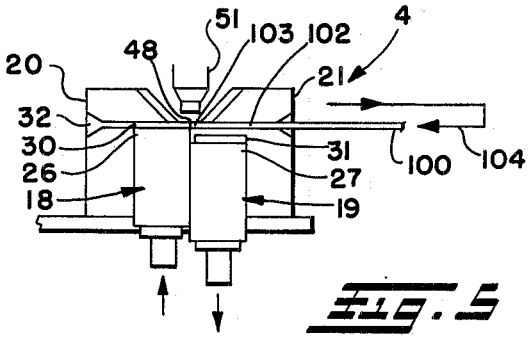

To align the sheared end 103 properly beneath the welding torch 51 of the strip joining assembly 4, the clamping device 18 handle 36 is rotated to move the movable clamp bar 26 and, particularly, the edge wall stop portion 48 thereof into the clearance space 32, as shown in FIG. 5. Then the first strip 100 may be moved back in the direction of the arrow 104 until the end 103 abuts the edge wall stop portion 48 placing the end 103 in alignment with the welding torch 51.

Figure 7:
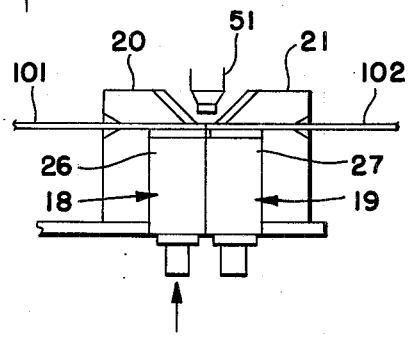
Figure 6:
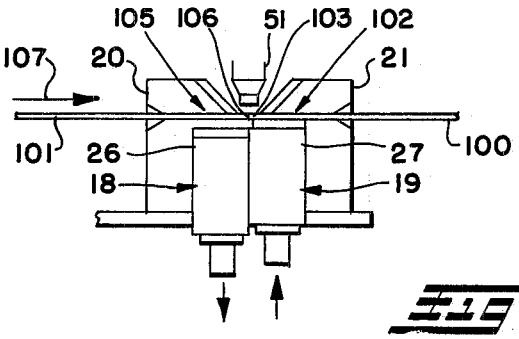

Referring now to FIG. 6, the clamping device 19 is actuated again to clamp the trailing end 102 in its aligned position, and the clamping device 18 is withdrawn to open the clearance space 32 thereabove for receiving the leading end 105 of the second strip 101. The leading end 105 of the second strip 101 preferably also is crop sheared in the crop shear assembly 2 to form a clean linear end 106 thereon, and that leading sheared end 106 then is slid in the direction of the arrow 107 into the clearance space 32 above the movable clamp bar 26 to abutment with the end 103 of the first strip 100. Upon actuation again of the clamping device 18 the leading end 105 of the second strip 101 is clamped in position, as shown in FIG. 7, with the two sheared ends 103, 106 firmly held in relatively fixed position and substantially supported from below relative to the welding torch 51 for welding thereof.

After the trailing end 102 and leading end 105 have been aligned and clamped, as described above, the mechanical switch device 72 may be operated to shift the movable belt clamping arm 69 downward so that the belt clamping arm clamps the torch drive belt 66 to the torch carriage top 67, and the moving belt automatically moves the torch carriage 53 and the welding torch 51 along the linear extent of the aligned strip ends to weld the same. After the welding operation has been completed, the mechanical switch device 72 may be operated to release the belt clamping arm 69 of the clutch mechanism 68 and the torch carriage and welding torch, which also preferably will have been deenergized, may be manually returned back to the torch storage location.

It should now be clear that the invention provides an uncomplicated, relatively streamlined, inexpensive apparatus for effecting crop shearing, aligning, clamping and welding or other joining of two strips, sheets, or the like of metal, plastic or other material.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

The embodiments of the invention in which an exclusive property or privilege is claimed are defined as follows:

1. A strip clamping and joining apparatus, comprising:

a frame bed for passage of strip material thereover, joining means mounted with respect to said frame bed for joining the trailing end of one strip to the leading end of another strip, first and second clamping means mounted on said frame bed, respectively, for clamping the strips in relative fixed position, and means for automatically moving said joining means during operation of the latter to join such strip ends, said means for automatically moving comprising motor means for producing a mechanical output, drive means driven by said motor means for providing linear motion in a direction substantially parallel to the linear extent of the aligned clamped strip ends, carriage means for moving said joining means relative to such aligned clamped strip ends to join the same, and means for coupling said drive means and said carriage means, whereby said drive means may move said carriage means upon being connected thereto by said means for coupling, said drive means comprising a belt continuously driven by said motor means, and said means for coupling said drive means and said carriage means comprising a clamping arm on said carriage means, and means for moving said clamping arm into and out of clamping engagement with said belt.

2. A strip clamping and joining apparatus as set forth in claim 1, wherein each of said clamping means includes an upper fixed clamp bar, a lower movable clamp bar, and actuating means for moving said lower movable clamp bar toward said upper fixed clamp bar to clamp a strip and away from said upper fixed clamp bar to provide a clearance space therebetween for relatively unimpeded passage of a strip through said clamping means, at least one of said lower movable clamp bars including stop means movable into said clearance space at least partially to block the same for locating the end of the opposite strip brought into abutment therewith in alignment with said joining means.

3. A strip clamping and joining apparatus as set forth in claim 1 wherein said clamping arm includes means for clamping said belt against said carriage means when brought into clamping engagement with said belt.

4. A method of joining the trailing end of a first strip with respect to the leading end of a second strip utilizing upstream and downstream clamping means each including an upper fixed clamp bar and a lower vertically movable clamp bar for clamping and locating the strip ends at a strip joining position comprising the steps of moving the lower clamp bars vertically downwardly away from the upper clamp bars to provide a clearance space therebetween for relatively unimpeded passage of the strips through the clamping means and for locating the trailing end of the first strip at a shearing station upstream of the upstream clamping means, actuating at least one of said clamping means to clamp the first strip during shearing, shearing the trailing end of the first strip upstream of the clamping means, releasing said clamping means, positioning the trailing end of the first strip downstream of the upstream clamping means, the vertically movable clamp bar of at least the upstream clamping means including stop means movable vertically upwardly into the clearance space at least partially to block the same for locating the trailing end of the first strip brought into abutment therewith in alignment with strip joining means, moving the stop means vertically upwardly into such clearance space, moving the trailing end of the first strip in an upstream direction into engagement with the stop means, clamping the first strip by vertical upward movement of the downstream lower vertically movable clamp bar, withdrawing the stop means vertically downwardly from the clearance space, shearing the leading end of the second strip upstream of the clamping means, moving the leading end of the second strip in a downstream direction through the clearance space between the clamp bars of the upstream clamping means and into abutment with the clamped trailing end of the first strip, clamping the second strip by vertical upward movement of the upstream lower vertically movable clamp bar, and thereafter joining the strip ends together.

5. The method as set forth in claim 4 wherein prior to joining of the strip ends together a clamping arm on a carriage means for the joining means is moved into clamping engagement with a continuously driven belt to cause the carriage means and thus the joining means mounted thereon to move relative to the aligned clamped strip ends to join the same.

6. A method of joining the trailing end of a first strip with respect to the leading end of a second strip utilizing upstream and downstream clamping means each including an upper fixed clamp bar and a lower vertically movable clamp bar for clamping and locating the strip ends at a strip joining position comprising the steps of moving the lower clamp bars vertically downwardly away from the upper clamp bars to provide a clearance space therebetween for relatively unimpeded passage of the strips through the clamping means, positioning the trailing end of the first strip downstream of the upstream clamping means, the vertically movable clamp bar of at least the upstream clamping means including stop means movable vertically upwardly into the clearance space at least partially to block the same for locating the trailing end of the first strip brought into abutment therewith in alignment with strip joining means, moving the stop means vertically upwardly into such clearance space, moving the trailing end of the first strip in an upstream direction into engagement with the stop means, clamping the first strip by vertical upward movement of the downstream lower vertically movable clamp bar, withdrawing the stop means vertically downwardly from the clearance space, moving the leading end of the second strip in a downstream direction through the clearance space between the clamp bars of the upstream clamping means and into abutment with the clamped trailing end of the first strip, clamping the second strip by vertical upward movement of the upstream lower vertically movable clamp bar, and thereafter joining the strip ends together.

* * * * *